US007381175B2

(12) United States Patent
Dawson et al.

(10) Patent No.: US 7,381,175 B2
(45) Date of Patent: Jun. 3, 2008

(54) COMPOUND FILTER ROD MAKING APPARATUS AND PROCESS

(75) Inventors: John Dawson, Richmond, VA (US); Loren Duvoket, Goochland, VA (US); Travis Garthaffner, Chesterfield, VA (US); Rashard Thurman, Richmond, VA (US); Charles Gary Atwell, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 48 days.

(21) Appl. No.: 11/019,786

(22) Filed: Dec. 22, 2004

(65) Prior Publication Data

US 2006/0135335 A1 Jun. 22, 2006

(51) Int. Cl.
*B65B 1/26* (2006.01)
*B65B 1/24* (2006.01)

(52) U.S. Cl. ..... 493/47

(58) Field of Classification Search ..... 131/202, 131/335; 493/47, 50; 53/529, 530, 111 R
See application file for complete search history.

(56) References Cited

U.S. PATENT DOCUMENTS

| | | | | | |
|---|---|---|---|---|---|
| 3,370,514 | A | | 2/1968 | Rome | |
| 3,813,996 | A | * | 6/1974 | Labbe et al. | 493/44 |
| 3,844,200 | A | * | 10/1974 | Sexstone | 493/45 |
| 3,847,064 | A | * | 11/1974 | Berger | 493/44 |
| 4,016,830 | A | | 4/1977 | Sexstone | |
| 4,184,412 | A | | 1/1980 | Hall | |
| 4,214,508 | A | * | 7/1980 | Washington | 493/48 |
| 4,291,711 | A | | 9/1981 | Berger | |
| 4,522,616 | A | * | 6/1985 | Hyde et al. | 493/44 |
| 5,387,285 | A | * | 2/1995 | Rivers | 118/325 |
| 5,542,901 | A | * | 8/1996 | Atwell et al. | 493/47 |
| 5,743,275 | A | * | 4/1998 | Dawson et al. | 131/84.1 |
| 6,656,412 | B2 | * | 12/2003 | Ercelebi et al. | 264/518 |
| 6,723,033 | B1 | * | 4/2004 | Scott et al. | 493/48 |
| 2002/0119874 | A1 | * | 8/2002 | Heitmann et al. | 493/39 |

FOREIGN PATENT DOCUMENTS

| | | | | |
|---|---|---|---|---|
| DE | 100 10 176 | | 9/2001 | |
| WO | WO-00/51451 | | 9/2000 | |
| WO | WO 00/51451 | * | 9/2000 | 493/48 |

* cited by examiner

*Primary Examiner*—Rinaldi I. Rada
*Assistant Examiner*—John Paradiso
(74) *Attorney, Agent, or Firm*—Connolly Bove Lodge & Hutz LLP

(57) ABSTRACT

Machinery and process for continuously making a compound filter rod include a tow transport for continuously delivering an expanded fiber tow while compressing the tow as it travels in a downstream direction. At least one rotating pocket wheel has a plurality of spaced apart pockets therein, and a filter media supply delivers media to the pockets. A vacuum source applied to the pockets of the rotating wheel operates to draw filter media into the pockets from the filter media supply. An air transport tube in alignment with the pockets of the rotating pocket wheel discharges the filter media from the pockets as they rotate past the transport tube. The discharged filter media is delivered to the tow transport into interior portions of the fiber tow. Subsequently, the rod is wrapped with filter paper.

10 Claims, 1 Drawing Sheet

COMPOUND FILTER ROD MAKING APPARATUS AND PROCESS

BACKGROUND OF THE INVENTION

The present invention relates to compound filter making apparatus and processes, and more particularly to apparatus and processes for continuously making in a single operation a compound cigarette filter rod having spaced apart measured amounts of filter media on the inside thereof and an outside sheath of tow material.

Specialty cigarette filters containing particular filter media, such as granulated filtration or flavor media, for example, are typically made by combining filter segments, each individually made and subsequently combined in a separate filter combining machine. Some are created by combining two filter plugs of cellulose acetate tow or similar material with a space between the plugs, and then filling the space with granular material. Other arrangements include combining plugs of one composition with plugs of a different composition. In each instance, the individual filter components are initially made in separate operations and then combined together in another operation to produce the finished product.

SUMMARY OF THE INVENTION

Accordingly, one of the objects of the present invention is a single filter making operation for producing a continuous compound filter rod having interior amounts of spaced apart filter media and an outside sheath of tow material.

Another object of the present invention is a compound filter rod making process which is simple, but highly efficient in the production of such filters.

The present invention allows the application of one or more granulated media into a continuous cellulose acetate filter such that the effect of a combined filter is achieved in one operation. Another advantage of the invention is the ease in which different media and different amounts of media are produced to easily create a variety of different product designs. Another advantage is in the concentration of the smoke stream when the finished cigarette is consumed. Because the granules of the filter are inserted into a continuous cellulose acetate flow, the tow fibers that surround the media are more tightly packed then fibers in the filter where there are no granules. This increased draw resistance forces the air flow through the granulated media thereby increasing the efficiency of the granules to filter and/or flavor the smoke stream.

In the overall operation, specifically sized pockets of filter media deliver the correct amount of media. An appropriately sized tube having an air assist discharges the filter media from the pockets along a path created by the tube. The discharge end of the tube is placed in a cellulose acetate stream such that the granules are delivered to the center of a filter rod being formed. The components are synchronized to the filter manufacturing machinery so that the position of the delivered media amounts is repeated in exact intervals and registered with cutting of the rod into individual cigarette filters.

As each full pocket of filter media leaves the filling zone they pass over a tube transport entry position. Vacuum is released and air pressure applied through a perforated pocket "bottom" to expel the media into the transport tube and into the center of the filter rod being formed.

In accordance with the present invention, machinery for continuously making a compound filter rod comprises a tow transport for continuously delivering an expanded fiber tow while compressing the tow as it travels in a downstream direction. At least one rotating pocket wheel has a plurality of spaced apart pockets therein, and a filter media supply delivers media to the pockets. A vacuum source applied to the pockets of the rotating wheel functions to draw filter media into the pockets from the filter media supply. Ultimately, an air transport tube in alignment with the pockets of the rotating wheel discharge the filter media from the pockets as they rotate past the transport tube. The discharged filter media is delivered to the tow transport and into interior portions of the fiber tow.

Preferably the tow transport includes a conical transport jet having a decreasing cross-sectional area for compressing the tow in the downstream direction.

The filter media in the supply may comprise granular material or pre-measured capsules. Moreover, the filter media may be flavored, if desired.

The vacuum source comprises a vacuum dome on the rotating pocket wheel communicating with the pockets except where the air transport tube is in alignment with the pockets.

In one embodiment of the invention the pockets of the rotating pocket wheel comprise inner pockets spaced apart along an inner circular line having an inner radius together with outer pockets arranged along an outer concentric circular line having a slightly longer outer radius. Moreover, the filter media supply may comprise an inner annular trough of filter media having an inner radius together with an outer concentric angular trough of filter media having a slightly longer outer radius. In this particular arrangement the inner pockets are in alignment with the inner trough and the outer pockets are aligned with the outer concentric trough. Preferably, different filter media is supplied to each of the troughs.

In another embodiment of the invention the filter media supply comprises a pick-up chamber filled with filter media and positioned so that the pockets of the rotating pocket wheel pass by the chamber to thereby expose the pockets to the filter media therein.

In sill another embodiment of the invention a second rotating pocket wheel has a plurality of spaced apart pockets therein. The wheels are counter rotating, and in this arrangement the air transport tube includes a pair of tube portions at an entrance end thereof, one portion in alignment with the pockets of the first wheel and the portion in alignment with the other pockets of the second wheel.

All embodiments of the present invention include a filter paper supply constructed and arranged to deliver filter paper to the filter tow with the filter media therein for to wrapping the filter tow with the paper.

The present invention also includes a process of continuously making a compound filter rod comprising the steps of continuously delivering an expanded fiber tow in a downstream direction, and compressing the tow as it travels in that direction. Further steps include preparing predetermined amounts of filter media by vacuum drawing the filter media into a plurality of pockets, and discharging the filter media from the pockets. The filter media is delivered to the interior of the fiber tow. Subsequently the fiber tow and filter media therein are wrapped with filter paper.

The filter media may comprise granular material or pre-measured capsules, each of which may include a flavorant. Moreover, different filter media may be used.

BRIEF DESCRIPTION OF THE DRAWINGS

Novel features and advantages of the present invention in addition to those mentioned above will be readily apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
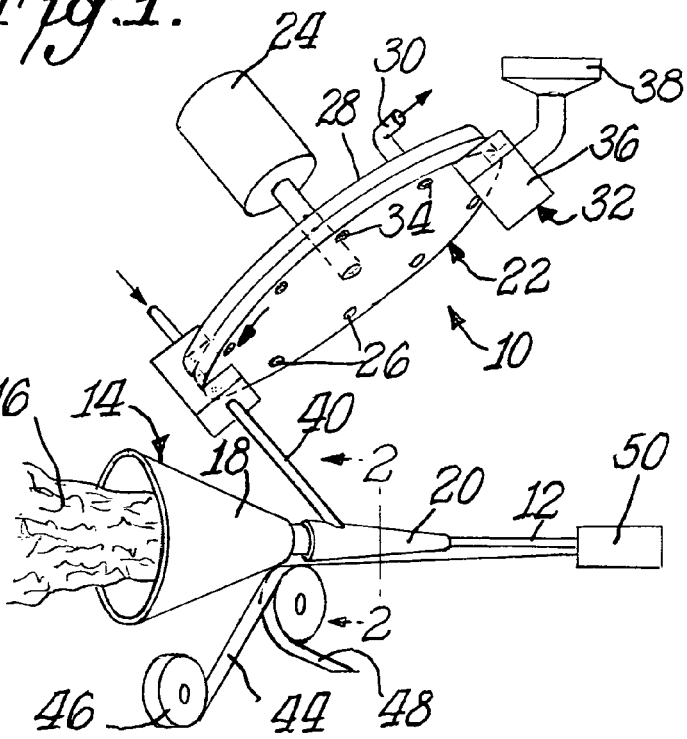
FIG. 1 is a schematic perspective view of machinery for continuously producing a compound cigarette filter rod, according to the present invention.

Referring in more particularity to the drawings, FIG. 1 illustrates machinery 10 for continuously making a compound filter rod 12. Machinery 10 comprises a tow transport jet 14 for continuously delivering on expanded fiber tow 16 of cellulose acetate or similar material while compressing the tow as it travels in a downstream direction. The tow transport jet 14 includes a funnel 18 and tongue 20. A rotating pocket wheel 22 driven by a synchronious motor 24 has a plurality of spaced apart pockets 26 arranged around the periphery of the pocket wheel. A stationary suction dome 28 next to the pocket wheel applies suction from source 30 to the individual pockets 26 as the wheel rotates.

A filter media supply 32 operates to deliver filter media 34 to the pockets 26. Each of the pockets has foraminous or perforated base which allows suction to be applied, but which prevents the filter media 34 from passing through the base. The filter media may comprise any material normally utilized in the production of cigarette filters, and such material may include but not limited to charcoal and activated carbon granules, carbon beads and capsules, for example. Moreover, other materials may be liquid filled flavored spheres, and flavored spheres of any size. The filter media supply of FIG. 1 is in the form of a media pick-up chamber 36 supplied by a media funnel 38.

Machinery 10 further includes an air transport tube 40 in alignment with the pockets 26 of the pocket wheel 22 for discharging the filter media 34 from the pockets as they rotate past the transport tube. The tube is arranged to enter the tongue 20 of the tow transport jet 14, and the discharge end 42 of the tube is positioned at the interior of the fiber tow 16 so that the tube delivers the filter media 34 to the interior portions of the tow.

As the compound filter rod 12 exits the tongue 20 of the tow transport jet, the rod is wrapped with cigarette paper 44 from a supply 46, the paper being delivered to the rod by a continuous belt 48. The rod is wrapped with paper at location 50 downstream from the exit end of tongue 20.

Operation of the machinery 10 is as follows. The pocket wheel being driven by the synchronious motor 24 causes the pockets 26 to come into contact with the pick-up chamber 36 where the pockets are exposed to the filter media 34 within the chamber. Suction from dome 28 is applied to the pockets which causes the filter media 34 to fill into the pockets. Continued rotation of the pocket wheel ultimately positions the pockets filled with filter media at the air transport tube 40 where the filter media is discharged through the tube into the tongue 20, ultimately exiting the discharge end 42 of the tube into the fiber tow 16. Paper 44 is then wrapped around the compound filter rod 12, as explained above.

Figure 5:
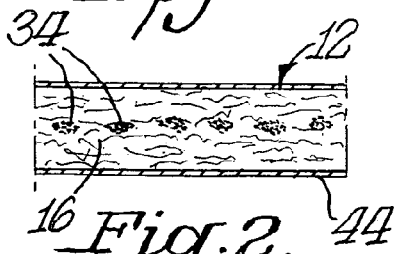
FIG. 5 is a longitudinal sectional view of a continuous compound filter rod produced by the machinery of FIGS. 1 through 4, according to the present invention.
Figure 2:
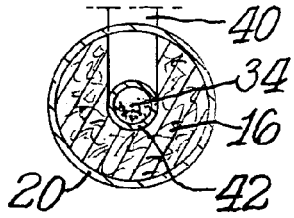
FIG. 2 is a sectional view taken along line 2-2 of FIG. 1.

FIG. 2 shows the filter media 34 exiting the discharge end 42 of the air transport tube 20, the media being positioned interiorly of the fiber tow 16. Moreover, FIG. 5 is a longitudinal sectional view illustrating the filter rod 12 with paper 44 on the outside thereof surrounding the fiber tow 16 and the interiorly positioned charges of filter media 34.

Figure 3:
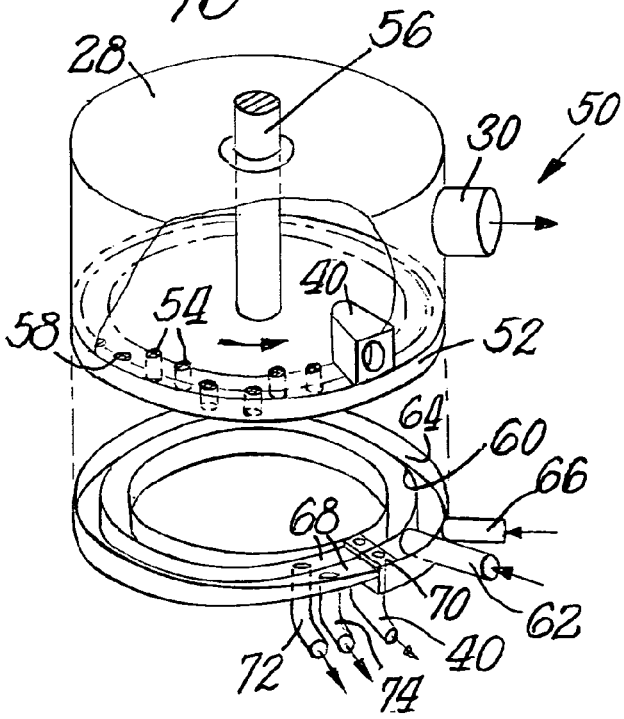
FIG. 3 is an exploded perspective view of another rotating pocket wheel of machinery for continuously producing a compound filter rod, according to the present invention.

FIG. 3 illustrates an alternate embodiment of the present invention comprising machinery 50 for producing a compound filter rod similar to rod 12 produced by the machinery 10 of FIG. 1. Similar reference numerals are utilized to identify similar parts. One significant difference in the machinery 50 is that the rotating pocket wheel 52 includes a plurality of inner pockets 54 spaced apart along an inner circular line having an inner radius relative to axis 56 of the rotating pocket wheel. Additionally, the wheel includes a plurality of outer pockets 58 arranged along an outer concentric circular line having a slightly larger outer radius.

Machinery 50 includes a supply of filter media for the inner pockets 54 and a separate supply of filter media for the outer pockets 58. Specifically, an inner trough 60 of filter media is positioned directly below the inner circular line of pockets 54, and that trough is supplied with filter media through supply line 62. Similarly, an outer concentric trough 64 is in alignment with the outer concentric circular line of outer pockets 58, and a line 66 supplies a different filter media to the outer trough.

Operation of the machinery 50 is similar in many respects to the operation of machinery 10 of FIG. 1. The vacuum dome remains stationary along with the filter media supply in the form of inner and outer troughs 60, 64, respectively. As the pocket wheel 52 rotates, filter media in the troughs 60, 64 is drawn into the inner pockets 52 and the outer pockets 58 by the vacuum in adjacent dome 28. As the filled pockets approach the point of discharge the bottom of each trough slopes in an upward direction at 68 to thereby position the pockets adjacent and directly above the discharge location 70. Excess filter media exits the troughs at the upwardly sloping portions thereof through discharge lines 72, 74, and that excess is recycled back to the supply lines 62, 66. When the pockets reach the point of discharge 70, the air transport tube 40 delivers the charges of filter media from the pockets to the interior of the fiber tow in the same manner as described above in connection with machinery 10.

The arrangement of the inner and outer pockets 54, 58 is such that only one filled pocket is discharged at any one time. In this regard, the inner and outer pockets are staggered so that no inner and outer pockets are located on the same radius. The ultimate desired concentration of the compound filter rod 12 determines the location and number of pockets in the pocket wheel. In the specific arrangement of FIG. 3, two adjacent inner pockets are followed by two adjacent outer pockets and that sequence continues. Hence, the finished filter rod includes two charges of the filter media from trough 60 sequentially discharged into the fiber tow, and such discharge is followed by two charges of material from the outer trough 64.

Figure 4:
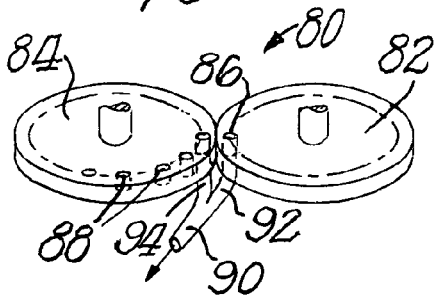
FIG. 4 is a perspective view of an alternative pocket wheel arrangement, according to the present invention.

The machinery 80 of FIG. 4 is slightly different from the machinery 10, 50 of FIGS. 1 and 3. The primary difference is that machinery 80 includes a pair of counter rotating pocket wheels 82, 84 each having a plurality of spaced apart pockets 86, 88 near the circumference of the wheels. The pockets are filled with filter media in the same manner described above, and the media is discharged from the pockets by an air transport tube 90. The tube includes a pair of entrance portions 92, 94, one in alignment with the pockets 86 of wheel 82 and the other in alignment with the pockets 88 of wheel 84. Otherwise, machinery 80 operates in the same manner as described above.

It should be understood that the above detailed description while indicating preferred embodiments of the invention are given by way of illustration only since various changes and modifications within the spirit and scope of the invention will become apparent to those skilled in the art from the detailed description. For example, the machinery 10 of FIG. 1 may also include an inner ring of pockets on the wheel and another pick-up chamber for supplying the inner pockets with filter media.

What is claimed is:

1. Apparatus for continuously making a compound filter rod comprising:

a tow transport for continuously delivering an expanded fiber tow while compressing the tow as it travels in a downstream direction, the tow transport including a conical transport jet having a decreasing cross-sectional area for compressing the tow in the downstream direction until it obtains a desired cross-sectional area;

at least one rotating pocket wheel having a plurality of spaced apart pockets therein;

a filter media supply positioned to deliver filter media to the pockets;

a vacuum source applied to the pockets of the rotating wheel constructed and arranged to draw filter media into the pockets from the filter media supply; and an air transport tube in alignment with the pockets of the rotating pocket wheel for discharging the filter media from the pockets as they rotate past the transport tube, the air transport tube having a discharge end interior of the conical transport jet for delivering the filter media to interior portions of the fiber tow as the tow is compressed in the conical transport jet and continues to be compressed as it travels downstream to obtain its desired cross-sectional area.

2. Apparatus for continuously making a compound filter rod as in claim 1 wherein the filter media in the filter media supply comprises granular material.

3. Apparatus for continuously making a compound filter rod as in claim 1 wherein the filter media in the filter media supply comprises pre-measured capsules.

4. Apparatus for continuously making a compound filter rod as in claim 1 wherein the vacuum source comprises a vacuum dome on the rotating pocket wheel communicating with the pockets except where the air transport tube is in alignment with the pockets.

5. Apparatus for continuously making a compound filter rod as in claim 1 wherein the pockets of the rotating wheel comprise inner pockets spaced apart long an inner circular line having an inner radius and outer pockets arranged along an outer concentric circular line having a slightly longer outer radius.

6. Apparatus for continuously making a compound filter rod as in claim 2 wherein the filter media supply comprises an inner annular trough of filter media having an inner radius and an outer concentric annular trough of filter media having a slightly larger outer radius, and wherein the inner pockets are in alignment with the inner trough and the outer pockets are aligned with the outer concentric trough.

7. Apparatus for continuously making a compound filter rod as in claim 6 wherein the filter media in the inner trough is different from the filter media in the outer concentric trough.

8. Apparatus for continuously making a compound filter rod as in claim 1 wherein the filter media supply comprises a pick-up chamber filled with filter media and positioned so that the pockets of the rotating pocket wheel pass by the chamber to thereby expose the pockets to the filter media therein.

9. Apparatus for continuously making a compound filter rod as in claim 1 including a second counter rotating pocket wheel having a plurality of spaced apart second pockets therein, and wherein the air transport tube includes a pair of tube portions at an entrance end thereof, one portion in alignment with the second pockets and the other portion in alignment with the other pockets.

10. Apparatus for continuously making a compound filter rod as in claim 1 including a filter paper supply constructed and arranged to deliver filter paper to the fiber tow with the filter media therein and to wrap the fiber tow with the paper.

* * * * *